US010159890B2

(12) United States Patent
Kreuzinger et al.

(10) Patent No.: US 10,159,890 B2
(45) Date of Patent: Dec. 25, 2018

(54) HEEL UNIT FORA TOURING SKI-BINDING

(71) Applicant: Markus Steinke, Ascholding (DE)

(72) Inventors: Michael Kreuzinger, Munich (DE); Markus Steinke, Ascholding (DE)

(73) Assignee: Markus Steinke, Ascholding (DE)

( * ) Notice: Subject to any disclaimer, the term of this patent is extended or adjusted under 35 U.S.C. 154(b) by 0 days.

(21) Appl. No.: 15/412,539

(22) Filed: Jan. 23, 2017

(65) Prior Publication Data

US 2017/0209771 A1 Jul. 27, 2017

(30) Foreign Application Priority Data

Jan. 23, 2016 (DE) ..... 10 2016 000 609

(51) Int. Cl.

| | |
|---|---|
| ***A63C 9/084*** | (2012.01) |
| ***A63C 9/08*** | (2012.01) |
| ***A63C 9/00*** | (2012.01) |
| ***A63C 7/10*** | (2006.01) |

(52) U.S. Cl.

CPC ..... *A63C 9/0807* (2013.01); *A63C 7/1046* (2013.01); *A63C 9/006* (2013.01); *A63C 9/0841* (2013.01); *A63C 9/0842* (2013.01); *A63C 9/0844* (2013.01); *A63C 2009/008* (2013.01)

(58) Field of Classification Search

CPC ... A63C 9/0807; A63C 9/0844; A63C 9/0841; A63C 7/1046; A63C 9/006; A63C 9/0842; A63C 2009/008

See application file for complete search history.

(56) References Cited

U.S. PATENT DOCUMENTS 3,900,206 A * 8/1975 Salomon ..... A63C 9/0842 280/618
4,002,354 A * 1/1977 Ramer ..... A63C 9/005 280/614
4,513,988 A * 4/1985 Svoboda ..... A63C 9/006 280/615

(Continued)

FOREIGN PATENT DOCUMENTS

DE 10 2010 006 218 A1 8/2011
DE 10 2012 206 879 A1 10/2013

(Continued)

OTHER PUBLICATIONS

European Search Report dated May 11, 2017 from corresponding European Patent Application No. 17152678.3, 7 pages.

(Continued)

*Primary Examiner* — Frank B Vanaman
(74) *Attorney, Agent, or Firm* — Ohlandt, Greeley, Ruggiero & Perle, L.L.P.

(57) ABSTRACT

A heel unit for a touring ski-binding, comprising, a heel member, wherein the heel member comprises a reception bowl for receiving the heel part of a ski boot and a biasing device for biasing the heel unit against a ski boot, and wherein the heel unit is switchable between a starting position for receiving or releasing the ski boot and a snap-in position for holding the ski boot, wherein the heel unit comprises a blocking means by means of which the heel unit can be blocked in the starting position, wherein the blocking means is switchable between a blocking position and a non-blocking position.

8 Claims, 7 Drawing Sheets

(56) References Cited

U.S. PATENT DOCUMENTS

| | | | | |
|---|---|---|---|---|
| 5,318,320 | A * | 6/1994 | Ramer | A63C 9/006 280/614 |
| 9,457,259 | B2 | 10/2016 | Brandl | |
| 2003/0137129 | A1* | 7/2003 | DuBuque | A63C 9/00 280/615 |
| 2012/0025489 | A1* | 2/2012 | Meindl | A63C 9/006 280/607 |
| 2013/0056960 | A1 | 3/2013 | Chickering-Ayers | |
| 2014/0070519 | A1* | 3/2014 | Fritschi | A63C 9/006 280/623 |

FOREIGN PATENT DOCUMENTS

| | | | |
|---|---|---|---|
| DE | 20 2013 009 713 | U1 | 3/2014 |
| DE | 10 2013 204 064 | A1 | 9/2014 |
| DE | 102013204065 | A1 | 9/2014 |
| EP | 0 199 098 | A2 | 10/1986 |
| EP | 1 961 463 | A1 | 8/2008 |
| EP | 2 281 614 | A1 | 2/2011 |
| EP | 2695647 | A1 | 2/2014 |
| EP | 2 705 883 | A1 | 3/2014 |
| EP | 2762209 | A2 | 8/2014 |
| WO | 2009/105866 | A1 | 9/2009 |
| WO | 2009/153615 | A1 | 12/2009 |

OTHER PUBLICATIONS

German Examination Report dated Nov. 3, 2016 from corresponding German Patent Application No. 10 2016 000 609.9, 4 pages.

* cited by examiner

HEEL UNIT FORA TOURING SKI-BINDING

CROSS-REFERENCE TO RELATED APPLICATIONS

The present application claims priority to German Patent Application No. 10 2016 000 609.9, filed on Jan. 23, 2016, the entirety of which is herein incorporated by reference.

TECHNICAL FIELD

The present invention relates to a heel unit for a touring ski-binding, comprising a heel member, the heel member comprises a reception bowl for receiving the heel part of a ski boot and a biasing device for biasing the heel unit against a ski boot, and wherein the heel unit is switchable between a starting position for receiving or releasing the ski boot and a snap-in position for holding the ski boot.

BACKGROUND ART

In general, compared to ordinary ski-bindings, ski-bindings for touring skis are characterized by being switchable between a climbing mode and a downhill mode. In the climbing mode only the front part of the ski boot is fixed to the ski so that the heel part of the ski boot can be lifted from the ski and set down on the ski. The front part of the ski boot rotates about a horizontal axis which is perpendicular to the longitudinal direction of the ski. In the downhill mode both the front part as well as the heel part of the ski boot are fixed to the ski.

Conventional touring ski-binding systems can be divided into bridge binding systems and pin binding systems. In terms of pin systems the bindings can be subdivided into a front unit and a heel unit. In the climbing mode the ski boot is pivot-mounted only by the front unit around a horizontal pivot axis extending perpendicular to the longitudinal direction of the ski.

Conventionally, touring ski-bindings have one or several climbing aids by means of which it is possible to increase the walking comfort in steep terrain. In the climbing mode the heel part of a ski boot can be set down on the climbing aid instead of the ski surface or a base plate, which leads to a less steep standing and accordingly to more comfort.

DE 10 2012 206 879 A1 for example shows a light weight ski binding with increased safety of release, DE 10 2010 006 218 A1 relates to a touring ski binding with a climbing aid, and EP 0 199 098 A2 shows a touring ski binding.

Activating or deactivating the different climbing aids known from the background art is very complex in general, as several hand movements are necessary. In unsteady terrain permanently activating and deactivating the climbing aid is pretty laborious. Often it is also required to lift the ski boot from the climbing aid in order to be able to deactivate the climbing aid. Especially in steep terrain these actions can be unpleasant.

DISCLOSURE OF THE INVENTION

Starting from the known background art it is an aspect of the present invention to provide an improved heel unit, which enables simple activation and deactivation of a climbing aid.

This task is solved by means of an apparatus according to the features of claim 1. Advantageous embodiments can be taken from the depending claims.

Accordingly, a heel unit for a touring ski-binding is given, which comprises a heel member, wherein the heel member comprises a reception bowl for receiving the heel part of a ski boot and a biasing device for biasing the heel unit against a ski boot, and wherein the heel unit is switchable between a starting position for receiving or releasing the ski boot and a snap-in position for holding the ski boot. In particular, the heel unit comprises a blocking means by means of which the heel unit can be blocked in the starting position, wherein the blocking means is switchable between a blocking position and a non-blocking position.

Thereby it is possible to prevent that the heel unit is being switched to the snap-in position. Thereby the heel part of the ski boot can be lifted from the heel unit, in particular from the reception bowl, or can be set down thereon. In this position the reception bowl serves as climbing aid. A ski boot that is mounted to a front unit pivotally around a horizontal transverse axis can be used in a climbing function.

Accordingly, the blocking means in the blocking position together with the heel member forms a climbing aid onto which the heel part of a ski boot can be lowered. No additional parts are necessary in order to provide a climbing aid for climbing in steep terrain. The heel member and in particular the reception bowl are adapted to the geometry of the ski boot and, thus, can provide an optimal support function.

Because the heel member can be blocked in the starting position a fast and comfortable switching to the snap-in position is possible. If the blocking means is set to the non-blocking position, the heel member can yield to the pressure of a ski boot and take-in the snap-in position. Lifting of the heel part of the ski boot is not required. Moreover, the binding can be switched directly from the provision of a climbing aid to the snap-in position.

Moreover, it is possible to provide the heel unit with a conventional heel member. That means it is possible to use a heel member of a downhill-binding for a touring ski-binding. If the blocking means is in the non-blocking position the heel member and, thus, the heel unit can take-in the snap-in position, in which the ski boot is retained on the ski. In the blocking position the blocking means prevents a vertical downward movement of the heel member, so that the heel member is retained in its starting position. If, now, the heel part of the ski boot is lowered onto the heel member, the heel member keeps its starting position, so that the heel part of the ski boot does not snap-in in the heel unit.

In a further embodiment the blocking means is disposed displaceable relative to the heel member. Thereby it is possible to switch the blocking means between the blocking position and the non-blocking position by means of a displacing movement.

In a further embodiment the blocking means is disposed on a base plate, wherein the base plate is disposed on a ski surface. Usually, conventional heel units already have a base plate. Accordingly, it is sufficient to dispose the blocking means on a conventional base plate or to integrate the blocking means in a conventional base plate. The base plate forms the interface between the heel unit and the ski.

In a further embodiment the base plate and the blocking means are displaceably coupled relative to each other by means of a groove guiding. The groove defines the displacement path of the blocking means with respect to the base plate. The groove can be disposed in the blocking means or in the base plate. If the groove is disposed in the blocking means, the base plate has a complementary guiding, for example a rail, which engages with the groove. If the groove is disposed in the base plate, the blocking means has the guiding. The length of the groove guiding allows the displacement of the blocking means between the blocking position and the non-blocking position. Furthermore, the groove guiding enables an exact positioning or displacing of the blocking means on the base plate.

A groove of the groove guiding which for example runs on the surface of the blocking means, can have slanting walls, so that when seen from the surface of the blocking means an undercut is provided. By means of a guiding on the surface of the base plate, which is complementary to the groove, the base plate can be securely retained in the groove.

The groove can be configured in a way, that it runs through the entire blocking means, i.e. so that the ends of the groove are open. Thus, it is possible that by means of the guiding residues, such as snow, located in the groove can be pushed-out of the groove.

In a further embodiment the heel unit comprises snap-in means in order to retain the blocking means in the blocking position and/or the non-blocking position. Thereby, it is prevented that the blocking means automatically loosens from the blocking position or the non-blocking position during the use of the heel unit. For example, the snap-in means can be provided by means of a biased bracket on the guiding of the blocking means, which interacts with a shaping in a groove of a base plate in which the blocking means is guided. At the height of the shaping the groove has a greater width, whereby the biased bracket of the blocking means can expand. In order to transfer the guiding of the blocking means from the broader area, i.e. the area of the shaping, of the groove to the narrower area of the groove a manual intervention of the user is required.

In a further embodiment the blocking means is displaceable in the longitudinal direction of the ski. In the longitudinal direction of the ski enough space is provided to push the blocking means out of the freedom of movement of the heel member. Hence, the non-blocking position can be defined in an area behind the heel member, for example, so that the blocking means are displaced in the longitudinal direction behind the heel member to allow a snapping of the heel unit.

In a further embodiment the blocking means can be positioned in the blocking position underneath the heel member. Thereby it is possible to prevent a vertical movement, i.e. a downward movement, of the heel member when a force presses the heel member downwards, i.e. towards the surface of the ski. Such a force can for example originate from the heel part of a ski boot. If a touring ski-binding is in the climbing position, in which a front unit pivotally mounts the ski boot around the horizontal transverse axis, the heel part of the ski boot can be set down onto the heel member without the heel member taking-in the snap-in position. In fact, by means of its positioning underneath the heel member the blocking means ensures that the heel unit is retained in the starting position.

In a further embodiment, the reception bowl comprises a flange, wherein in the starting position of the heel unit the flange can be brought into contact with a ski boot, and wherein in the blocking position the flange rests on the blocking means. In the non-blocking position the flange is taken along by means of downward movement of the heel part of the ski boot and, thus, triggers the snap-in position. In the blocking position of the heel unit the flange can serve as climbing aid onto which the heel part of the ski boot can be lowered or from which the heel part of the ski boot can be lifted, when the touring ski-binding is in the climbing position. Accordingly, no additional parts are necessary in order to provide a climbing aid for the climbing function of the touring ski-binding.

In a further embodiment the blocking means has at least one retaining member for holding down a stopper plate. Thereby it is possible that the ski brake is not released when the touring ski-binding is in the climbing mode. The stopper plate is biased against the surface of the ski by means of a torsion spring. Two arms extend from the stopper plate which almost run parallel to the longitudinal direction of the ski in the downhill mode. A ski boot clamped in the binding holds the stopper plate against the spring force on the surface of the ski. If the ski boot is released the spring pushes the stopper plate away from the surface of the ski, whereby the orientation of the arms changes. In this state the arms point downwards and protrude over the riding surface of the ski. In this way a lose ski can be slowed down.

In the climbing mode of the touring ski-binding the stopper plate is not contacted by the ski boot, so that the stopper plate together with the arms is pushed into the braking position by means of the spring. In order to prevent that in the blocking position the retaining members of the blocking means are at least partially displaced over the stopper plate so that the stopper plate is retained on the ski surface and the brake function is not released even if no ski boot is located on the stopper plate.

BRIEF DESCRIPTION OF THE DRAWINGS

Further embodiments and aspects of the present invention are being described in detail by means of the following description.

DETAILED DESCRIPTION OF THE EMBODIMENTS

Hereafter different embodiments are described according to the figures. The same elements, similar elements or elements with the same effect are identified with the same reference signs. In order to avoid redundancies there is partially no repeated description of these elements in the following description.

Figure 1:
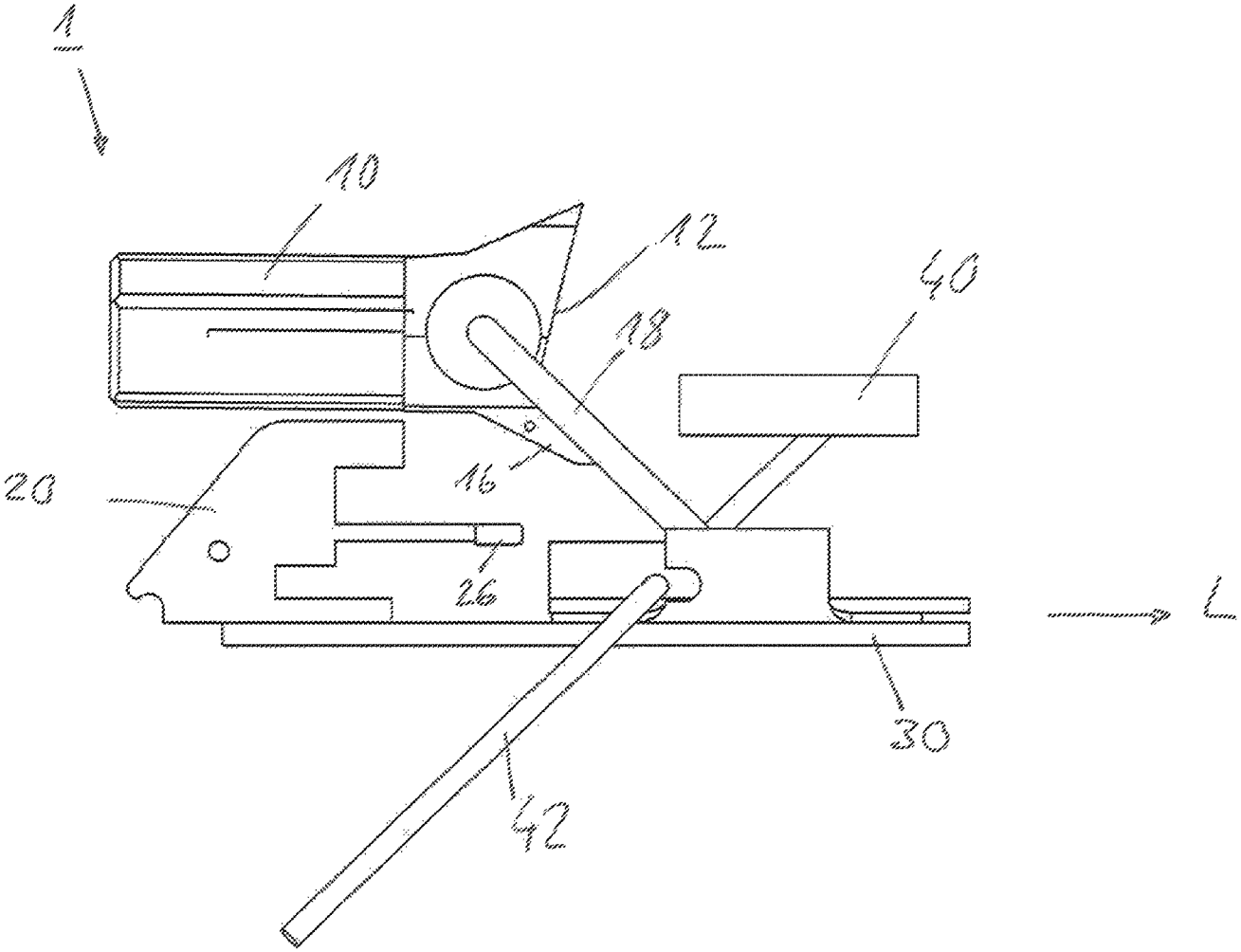
FIG. 1 schematically shows a side-view of a heel unit in the starting position, wherein the blocking means are in the non-blocking position, FIG. 2A schematically shows a perspective view of the heel unit of FIG. 1, wherein the blocking means are in a blocking position, FIG. 2B schematically shows a side-view of the heel unit of FIG. 2A, FIG. 3 schematically shows a side-view of the heel unit of FIG. 1, wherein the heel unit is in the snap-in position, FIG. 4A schematically shows a cross-sectional detailed view of a blocking means and a base plate, FIG. 4B schematically shows a cross-sectional view along the cutting line A-A of FIG. 4A, FIG. 5A schematically shows a cross-sectional detailed view of a blocking means and a base plate, wherein the blocking means is not snapped-in, FIG. 5B schematically shows a cross-sectional view along the cutting line C-C of FIG. 5A, and FIG. 5C schematically shows a cross-sectional detailed view of a blocking means and a base plate, wherein the blocking means is snapped-in the blocking position.

FIG. 1 shows a perspective view of a heel unit 1. The heel unit 1 comprises a base plate 30, which is attached to the surface of a ski. Usually, the base plate 30 is screwed onto the surface of the ski. Alternatively, the base plate 30 can also be adhered to the surface of the ski.

A base plate 30 is attached to the heel member 10 by means of two brackets 18. The heel member 10 has the purpose to receive the heel part of a ski boot and to bias the ski boot against the front unit. Accordingly, the heel member 10 comprises a reception bowl 12, which is suitable to receive the heel part of a ski boot. The heel unit 1 shown in FIG. 1 is in the starting position, in which the heel member 10 is ready to receive the heel part of the ski boot.

At a lower edge of the reception bowl 12 a flange 16 is disposed, onto which the heel part of the ski boot can be set down. A ski boot that is set down on the flange 16 can transfer the heel unit 1 to the snap-in position shown in FIG. 3 by means of a further downward movement. In this position the ski boot is snapped-in in the touring ski-binding, wherein the heel member 10 biases the ski boot against the front unit. The touring ski-binding is in the downhill mode.

The heel unit 1 further comprises a blocking means 20, which is disposed on the base plate 30. The blocking means 20 can be displaced between the non-blocking position shown in FIG. 1 and the blocking position shown in FIG. 2. The displacement of the blocking means 20 occurs in the longitudinal direction L of the ski. In the non-blocking position shown in FIG. 1 the blocking means 20 is inactive, so that the heel unit 1 can be transferred from the starting position shown in FIG. 1 to the snap-in position shown in FIG. 3 by means of the reception of the heel part of a ski boot.

Figure 2A:
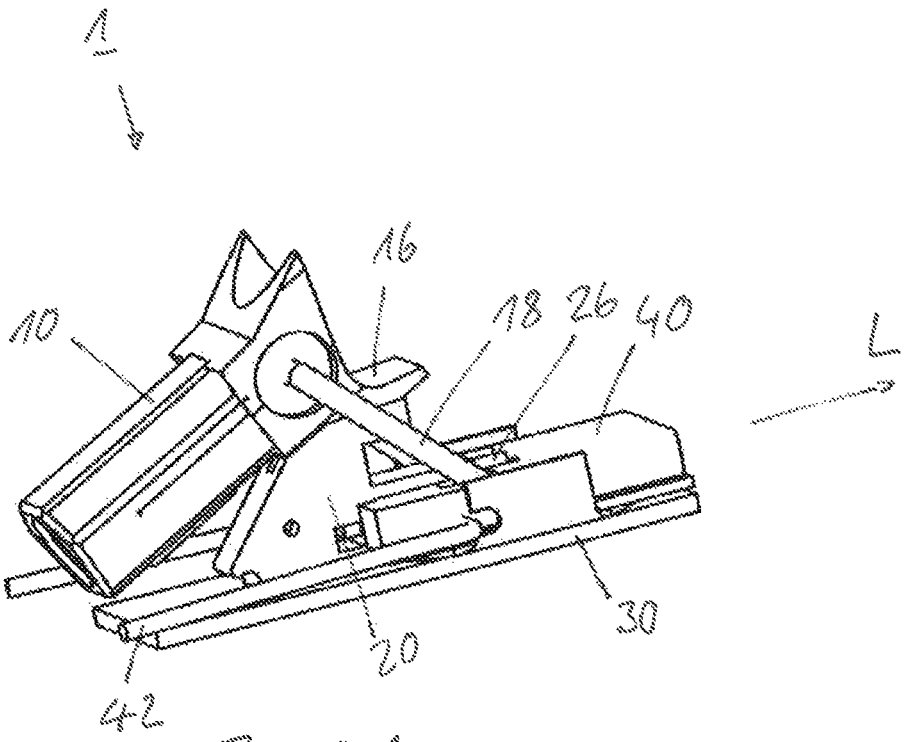

FIG. 2A shows the heel unit 1 of FIG. 1 with the difference that the blocking means 20 is in the blocking position. The blocking means 20 is closer to the stopper plate 40 with respect to the non-blocking position, so that it is disposed directly below the flange 16 of the heel member 10. The flange 16 contacts the surface 24 of the blocking means 20. Thereby, the blocking means 20 prevents that the flange 16 can move towards the base plate 30 when a force, which for example originates from the heel part of a ski boot, acts on the flange 16. Accordingly, in the blocking position the blocking means 20 prevents that the heel unit is being transferred to the snap-in position. Thus, a ski boot can be set down on the flange 16 without the heel unit 1 and, thus, the touring ski-binding snapping-in.

Figure 2B:
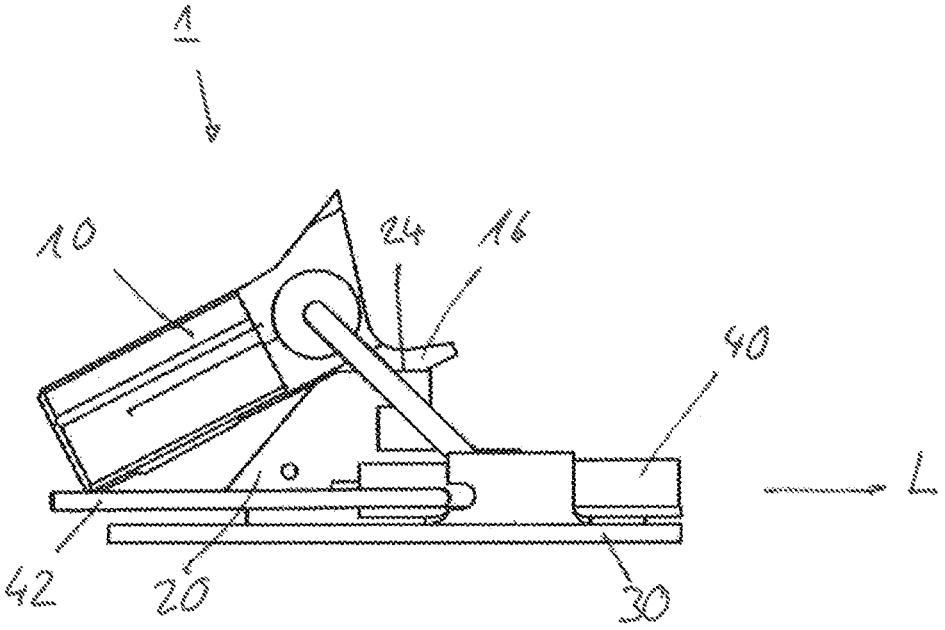

The FIGS. 1, 2A and 2B further show a stopper plate 40, which is disposed in the front area of the base plate 30. The stopper plate 40 is biased against the base plate 30 by means of a torsion spring. As can be taken from FIG. 1, two stopper arms 42 extend almost perpendicular to the longitudinal direction of the ski L when the stopper plate 40 is freely pushed away by means of the spring force of the base plate 30. If a force is applied to the stopper plate 40, so that the stopper plate 40 presses on the base plate, the coupling between the stopper plate 40 and the stopper arms 42 causes the stopper arms 42 to run almost parallel to the longitudinal direction of the ski.

FIGS. 1 and 2A further show that the blocking means 20 comprises retaining members 26. If the blocking means is in the blocking position as shown in FIG. 2, the retaining members 26 are partially displaced over the stopper plate 40 and hold the latter on the base plate 30 against the spring force acting on the stopper plate. Accordingly, the retaining members 26 in the blocking position of the blocking means 20 shown in FIG. 2 cause the stopper arms 42 to run almost parallel to the longitudinal direction of the ski L without a ski boot being on the stopper plate 40.

If the blocking means 20 is in the blocking position shown in FIGS. 2A and 2B, the reception bowl 12 together with the flange 16 can be stressed, wherein the heel unit 1 remains in the starting position. Thereby, the heel part of a ski boot can be lowered onto the flange 16 and can be lifted from the flange 16 so that the flange 16 functions as climbing aid when the touring ski-binding is in the climbing mode.

FIG. 2B shows a side-view of the heel unit of FIG. 2A. The flange 16 of the heel member 10 contacts the blocking means 20. Thereby, the flange 16 provides a climbing aid onto which the heel part of a ski boot can be lowered and from which the heel part of a ski boot can be lifted. The climbing aid increases the walking comfort in steep terrain.

Figure 3:
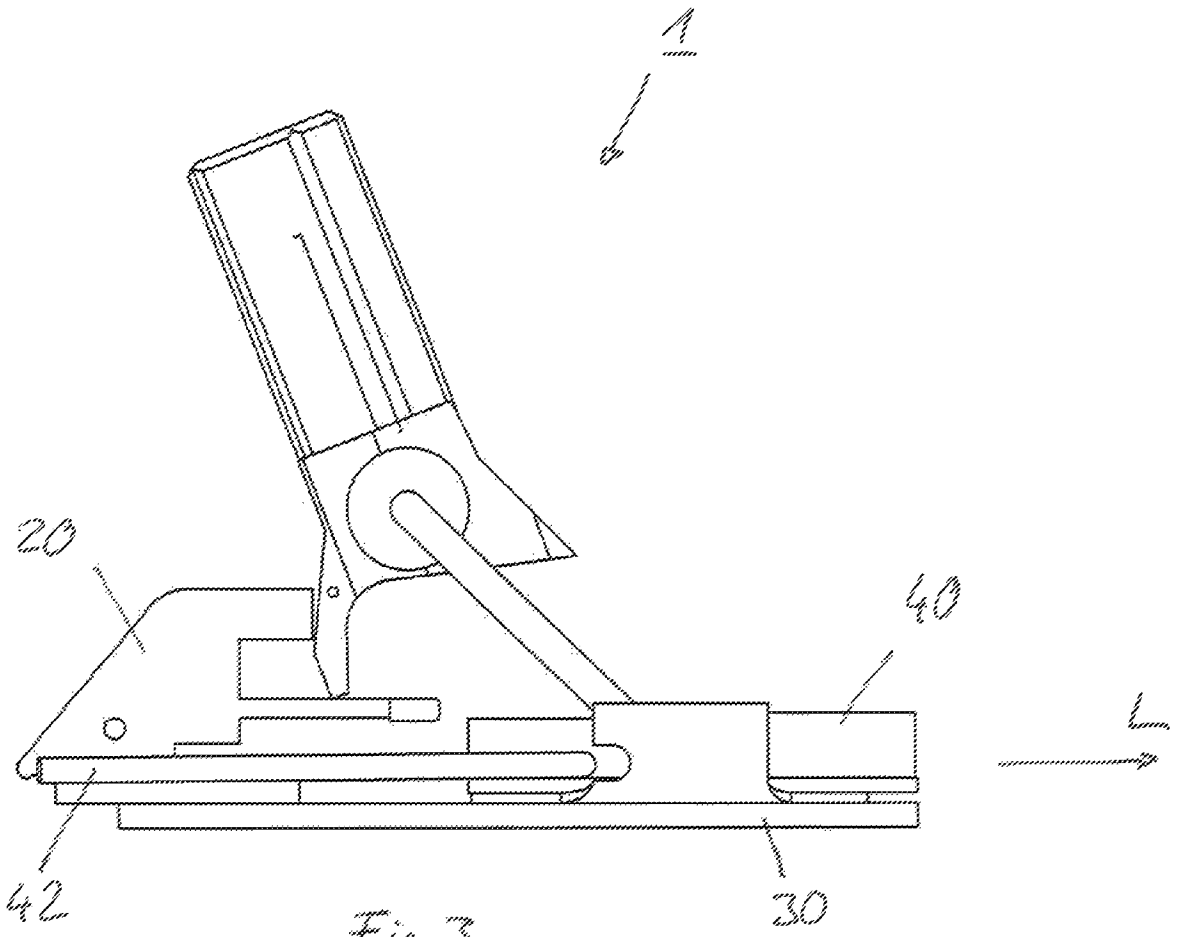

FIG. 3 shows a perspective view of the heel unit 1 of FIG. 1. The heel unit 1 takes-up this position when the heel part of a ski boot is biased against the base plate 30. I.e., the touring ski-binding is in the downhill mode, wherein a ski boot is firmly clamped in the touring ski-binding. FIG. 3 shows the blocking means 20 in a non-blocking position.

The stopper plate 40 is held in the adjacent position by means of the sole of a ski boot clamped in the touring ski-binding. If the ski boot is being released from the binding, for example by means of a fall, the stopper plate 40 can take-up a protruding position as it is not blocked by the blocking means 20. Thereby, the stopper arms 42 are being moved into the direction of the riding surface, so that the loosened ski can be slowed down.

Figure 4B:
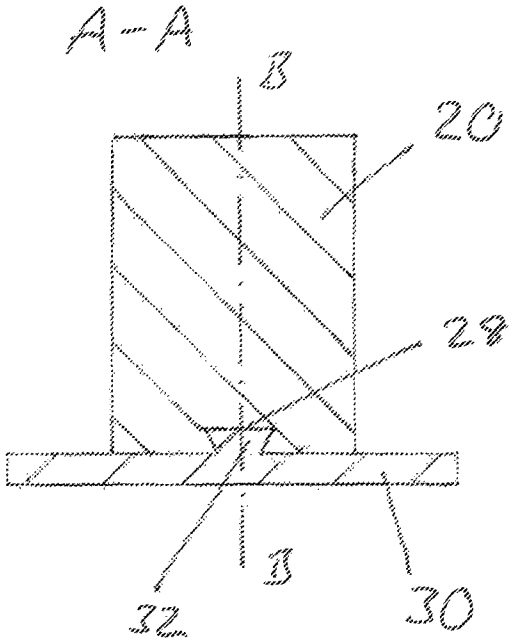
Figure 4A:
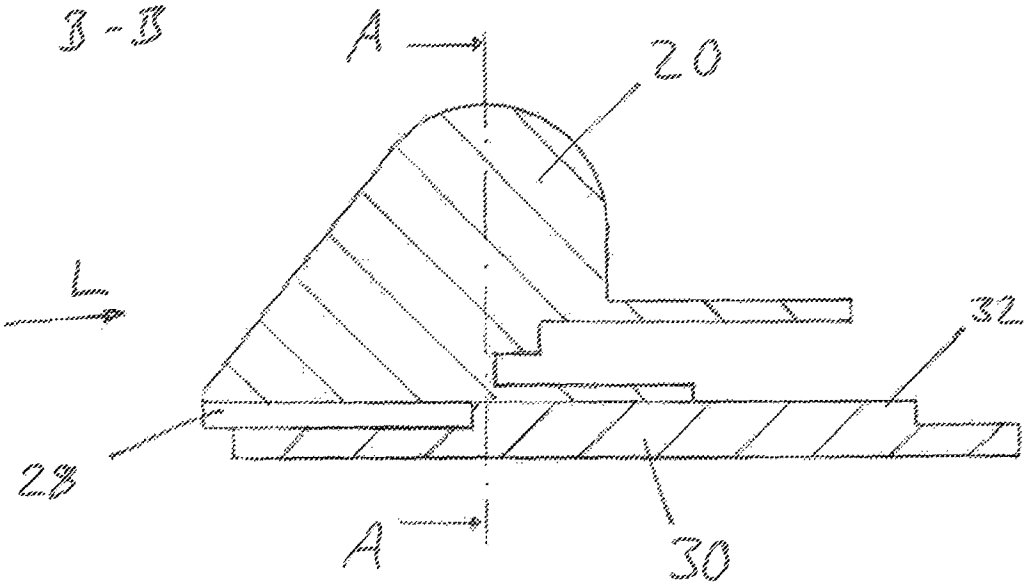

FIG. 4A shows the cut B-B of FIG. 4B through a detailed view of a blocking means 20 and a base plate 30. The blocking means 20 can be displaced in the longitudinal direction of the ski L. The blocking means 20 has a groove 28 by means of which it can slide on a guiding 32 of the base plate 30. Alternatively, the groove can be disposed in the base plate and the guiding can be disposed on the blocking means.

FIG. 4B shows a cross-sectional view along cutting line A-A of FIG. 4*a*. The lateral walls of the groove 28 have undercuts viewed from the base plate 30. The base plate comprises a guiding 32 configured complementary to the profile of the groove 28. The guiding 32 ensures that the blocking means 20 is retained on the base plate 30.

Figure 5B:
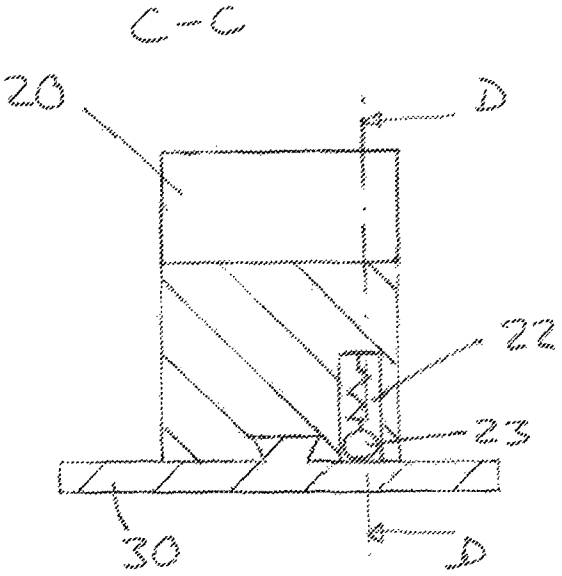
Figure 5A:
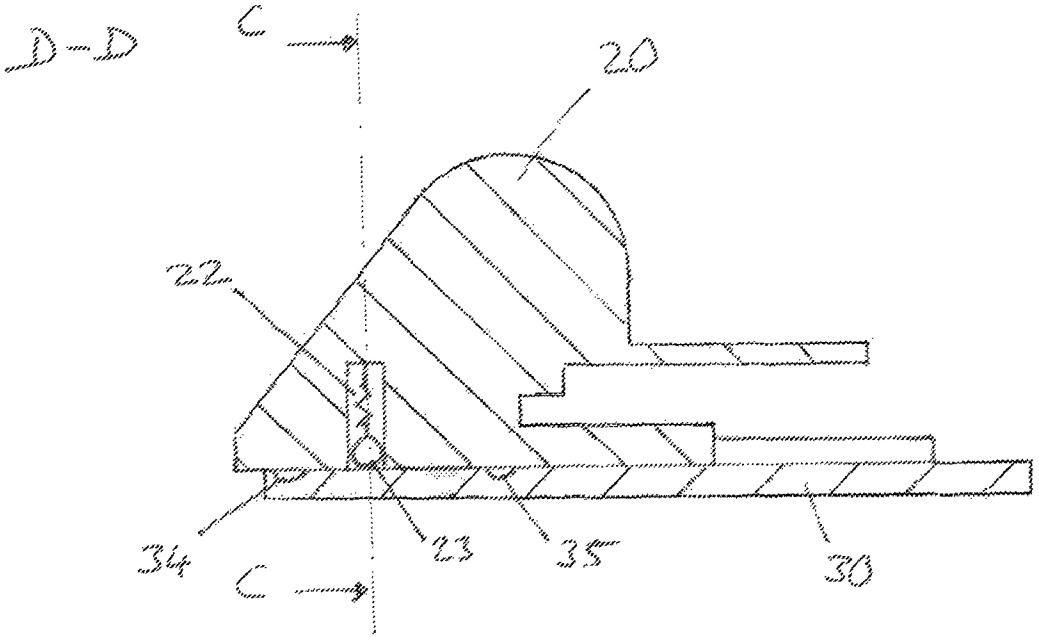

FIG. 5A shows the cut D-D of FIG. 5B through a detailed view of a blocking means 20 and a base plate 30. FIG. 5B shows a cross sectional view along cutting line C-C of FIG. 5*a*. The blocking means 20 comprises a snap-in means 22. The snap-in means 22 comprises a hole on a surface of the blocking means 20 facing the base plate 30. The snap-in means 22 further comprises a ball 23 biased by means of a spring, the ball 23 being disposed in the hole. The spring biases the ball 23 against the base plate 30.

Figure 5C:
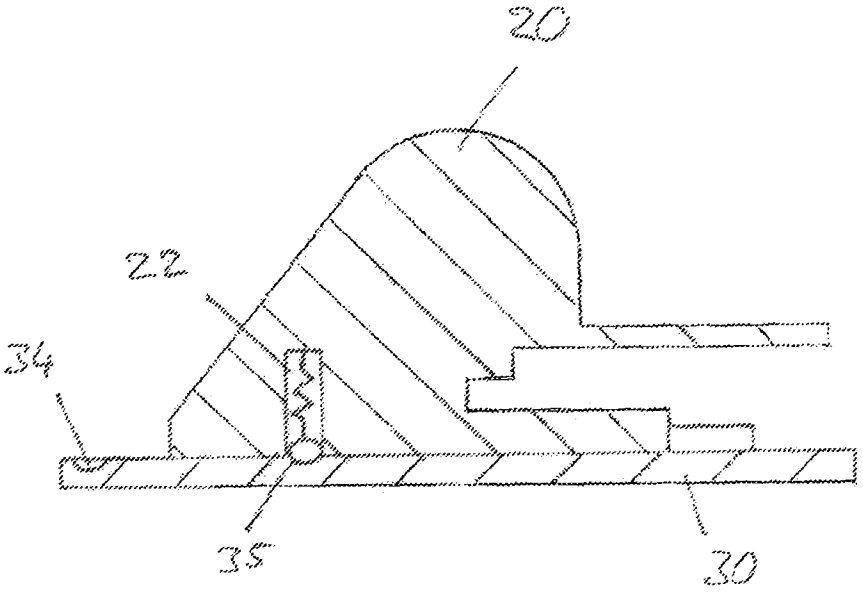

The base plate 30 has shapings 34, 35 into which the ball 23 can be pressed by means of the spring. The FIGS. 5A and 5B show the blocking means 20 in a non-snapped-in position. If the ball 23 snaps into the shaping 34, the blocking means is in the non-blocking position. If the ball 23 snaps into the shaping 35 as shown in FIG. 5C, the blocking means is in the blocking position. The spring force defines the force that is necessary to release the blocking means 20 from a snapped-in position.

The single components of the touring ski-binding are made of plastic and/or metal. The plastic components may comprise injection molded components. Generally, light-weight materials like polypropylene, fiber reinforced plastics and/or aluminum may be used.

As far as applicable, single features shown in the embodiments can be combined and/or replaced with each other without departing the field of the invention.

LIST OF REFERENCE NUMERALS

1 heel unit
10 heel member

12 reception bowl
16 flange
18 bracket
20 blocking means
22 snap-in means
23 ball
24 surface
26 retaining member
28 groove
30 base plate
32 guiding
34 shaping
35 shaping
40 stopper plate
42 stopper arm
L longitudinal direction of the ski
S pivot axis

The invention claimed is:

1. A heel unit for a touring ski-binding comprising:

a heel member, wherein the heel member comprises a reception bowl for receiving a heel part of a ski boot and a biasing device for biasing the heel unit against the ski boot, and wherein the heel unit is switchable between a starting position for receiving or releasing the ski boot in or from the reception bowl and a snap-in position for holding the ski boot, wherein the heel unit comprises a one-piece blocking element configured to block the heel unit when the heel unit is in the starting position, wherein the one-piece blocking element is switchable between a blocking position and a non-blocking position, wherein the reception bowl comprises a flange, wherein in the starting position of the heel unit the flange is configured to be brought into contact with the ski boot, and wherein in the blocking position the flange rests on the one-piece blocking element.

2. The heel unit according to claim 1, wherein the one-piece blocking element is disposed in a displaceable manner relative to the heel member.

3. The heel unit according to claim 1, wherein the one-piece blocking element is disposed on a base plate, wherein the base plate is disposed on a ski surface.

4. The heel unit according to claim 3, wherein the base plate and the one-piece blocking element are displaceably coupled relative to each other by a groove guiding.

5. The heel unit according to claim 1, wherein the heel unit comprises a snap-in retainer in order to retain the one-piece blocking element in the blocking position and/or the non-blocking position.

6. The heel unit according to claim 1, wherein the one-piece blocking element is displaceable in the longitudinal direction of a ski.

7. The heel unit according to claim 1, wherein the one-piece blocking element is configured to be positioned in the blocking position underneath the heel member.

8. The heel unit according to claim 1, wherein the one-piece blocking element has at least one retaining member for holding down a stopper plate.

* * * * *